US009385425B2

(12) United States Patent
Hara et al.

(10) Patent No.: US 9,385,425 B2
(45) Date of Patent: Jul. 5, 2016

(54) ANTENNA DEVICE

(71) Applicant: TDK CORPORATION, Tokyo (JP)

(72) Inventors: Yasuyuki Hara, Tokyo (JP); Kenji Endou, Tokyo (JP); Tetsuya Shibata, Tokyo (JP)

(73) Assignee: TDK CORPORATION, Tokyo (JP)

( * ) Notice: Subject to any disclaimer, the term of this patent is extended or adjusted under 35 U.S.C. 154(b) by 334 days.

(21) Appl. No.: 13/896,594

(22) Filed: May 17, 2013

(65) Prior Publication Data

US 2013/0335289 A1 Dec. 19, 2013

(30) Foreign Application Priority Data

Jun. 14, 2012 (JP) ..... 2012-135037

(51) Int. Cl.

| | |
|---|---|
| ***H01Q 1/52*** | (2006.01) |
| ***H01Q 1/24*** | (2006.01) |
| ***H01Q 9/42*** | (2006.01) |
| ***H01Q 21/28*** | (2006.01) |

(52) U.S. Cl.

CPC ..... *H01Q 1/52* (2013.01); *H01Q 1/243* (2013.01); *H01Q 1/521* (2013.01); *H01Q 21/28* (2013.01); *H01Q 9/42* (2013.01)

(58) Field of Classification Search

CPC ..... H01Q 1/52; H01Q 1/521

See application file for complete search history.

(56) References Cited

U.S. PATENT DOCUMENTS

| | | | | |
|---|---|---|---|---|
| 7,830,329 | B2 | 11/2010 | Fukushima et al. | |
| 2003/0189519 | A1 | 10/2003 | Rutfors et al. | |
| 2009/0237319 | A1 * | 9/2009 | Fukushima et al. | 343/848 |
| 2011/0136447 | A1 | 6/2011 | Pascolini et al. | |
| 2012/0218157 | A1 * | 8/2012 | Endou et al. | 343/741 |

FOREIGN PATENT DOCUMENTS

| | | | |
|---|---|---|---|
| CN | 1441978 | A | 9/2003 |
| CN | 102110873 | A | 6/2011 |
| WO | WO 2007/055232 | A1 | 5/2007 |

* cited by examiner

*Primary Examiner* — Robert Karacsony
(74) *Attorney, Agent, or Firm* — Oliff PLC

(57) ABSTRACT

The present invention is to provide an antenna device with the isolation among feedpoints being further improved. In order to achieve this goal, the present invention provides an antenna device provided with a substrate having a ground area, and a first conductor, a second conductor and a third conductor. In the antenna, one end of the second conductor is connected to the ground area via a first feedpoint and the other end of the second conductor is connected to the first conductor. A second feedpoint is included serially in the third conductor at any position. Further, at least part of the third conductor is disposed opposite to the first conductor, and both ends of the third conductor are connected to the ground area.

2 Claims, 9 Drawing Sheets

ANTENNA DEVICE

The present invention relates to an antenna device.

BACKGROUND

Recently, the quantity of antenna devices equipped in radio communication equipments such as mobile phones and PDAs (Personal Data Assistance) is growing with the increase of communication systems. Thus, such an antenna device should be improved so that a single antenna element is able to respond to multiple communication systems. Also, it is considered to be necessary to make recent radio devices respond to multiple communication systems such as GPS (Global Positioning System), Bluetooth (a registered trademark) or LTE (Long Term Evolution) at the same time. The antenna device disclosed in Patent document 1, for example, is an antenna device meeting such requirements.

PATENT DOCUMENTS

Patent 1: WO2007/055232

SUMMARY

When the above-mentioned radio communication equipment is provided with multiple communication systems, it is necessary to ensure that no interference is caused by electrical signals among antenna devices corresponding to each communication system.

In particular, if multiple antenna devices which correspond to communication systems having same or similar frequency bands are equipped in a same radio communication device, the radio waves from the antenna device of one communication system will be received by the antenna device of another communication system. In this way, the radio waves transmitted into air will be decreased and the operation of adjacent communication systems will be disturbed. Thus, in order to eliminate the interferences caused by electrical signals from each antenna device, it is necessary to make the antenna devices especially the feedpoints isolated from each other and also to lower the correlation values.

Patent Document 1 has disclosed an antenna device in which a plurality of feedpoints is configured for a single radiation conductor and the isolation among the several feedpoints are well improved. However, these feedpoints are directly connected via conductors. Signal leakage happens among some feedpoints and the isolation is not sufficient.

The present invention has been made based on the problems mentioned above. And the objective of the present invention is to provide an antenna device in which the feedpoints are well isolated from each other.

In order to solve the mentioned problems, the antenna device of the present invention is provided with a substrate having a ground area, and a first conductor, a second conductor and a third conductor. In the antenna device, one end of the second conductor is connected to the ground area via a first feedpoint and the other end of the second conductor is connected to the first conductor. A second feedpoint is comprised serially in the third conductor at any position. Further, at least part of the third conductor is disposed opposite to the first conductor, and both ends of the third conductor are connected to the ground area.

Based on such a configuration, the first feedpoint and the first conductor are connected via the second conductor. The second feedpoint and the first conductor are not connected by a conductor and electricity is supplied in a non-contact way by magnetic coupling as the first conductor is disposed opposite to the third conductor. Therefore, the signal between the first feedpoint and the second feedpoint is not transmitted via a conductor. Accordingly, the interference among electrical signals transmitted by the conductor becomes less.

Further, the first feedpoint functions as a feedpoint corresponding to a monopole antenna which uses the first conductor and the second conductor as radiation conductors, and the second feedpoint serves as a feedpoint corresponding to a dipole antenna which uses the first conductor as a radiation conductor, since the resonance are in different directions, so the interferences caused by electrical signals passing through the ground area are inhibited and the isolation between two feedpoints is improved.

Then, the sentence that "a second feedpoint is comprised serially in the third conductor at any position" means that the third conductor is cut off at any point (including both end portions of the third conductor) and connected via the second feedpoint. The second feedpoint can be either disposed in the center of the third conductor or disposed between one end portion of the third conductor and the ground area.

In the present invention, the first conductor and the ground area respectively have a shape that is plane symmetrical with respect to a selected imaginary plane vertical to the primary plane of the substrate, and the connecting point of the first conductor and the second conductor is disposed on the imaginary plane.

With such a configuration, the first conductor and the ground area both have a shape that is plane symmetrical with respect to the imaginary plane. The standing waves that are excited by the second feedpoint and then generated in the first conductor are central symmetrically distributed in the imaginary plane. The space near the intersection point of the first conductor and the imaginary plane is in a virtual grounding state that nearly no potential change is found. Thus, by disposing the connecting point of the first conductor and the second conductor in the imaginary plane, the components of the signal passing from the second feedpoint to the first feedpoint via magnetic coupling will become less. Then, the isolation between feedpoints is improved.

Also, if the first feedpoint is disposed in the intersection line of the imaginary plane and the ground area and the second conductor is arranged on the imaginary plane, the symmetry of electricity will be improved as well as the isolation between feedpoints.

Further, it is important that the nodes of the electric field distribution of the standing waves are formed in the connecting point of the first conductor and the second conductor. For example, if the nodes of the electric field distribution of the standing waves are formed at said connecting point, the electricity remains well symmetrical even if the first conductor and/or the ground area are/is not exactly symmetrical with respect to the imaginary plane. In other words, the same effect will be obtained.

Further, two end portions of the third conductor are positioned so as to clamp the imaginary plane.

The electrical signal from the first feedpoint is transmitted to the first conductor through the second conductor. Regarding the connecting point of the first conductor and the second conductor as base point, the transmitted electrical signal passes in a reverse direction. So a magnetic field is generated near the first conductor in an opposite direction regarding the connecting point between the first and second conductors as base point. As the two end portions of the third conductor is disposed so as to clamp the imaginary plane, two magnetic fields with opposite directions will be coupled and counteracted. In this way, the components of the signal passing from the first feedpoint to the second feedpoint via magnetic coupling will become less. Then, the isolation between feedpoints will be further improved.

Further, the third conductor of the present invention has a shape that is substantially plane symmetrical with respect to the imaginary plane.

With such a configuration, the first conductor and the third conductor are oppositely disposed and the area where magnetic coupling is generated is formed to be plane symmetrical with respect to the imaginary plane. In this way, the two magnetic fields with opposite directions are equally coupled, most of which are counteracted. Thus, the components of the signal passing from the first feedpoint to the second feedpoint via magnetic coupling will become less. Then, the isolation between feedpoints will be further improved.

The electrical length of the third conductor is preferably sufficiently shorter than the wave length λ input to the feedpoint. In this way, as the distribution of the circuit generated in the third conductor becomes approximately uniform, the two sides that clamp the imaginary plane have a better symmetrical magnetic coupling and the isolation is improved as well. It is preferred that at least the electric length of the third conductor should be shorter than ¼ of λ in which the phase is not reversed.

Further, the second feedpoint of the present invention is disposed on the imaginary plane.

By this structure, the whole antenna including the feedpoints is plane symmetrical with respect to the imaginary plane. With the same reasons mentioned above, the signal from the first feedpoint to the second feedpoint via magnetic coupling has most of the components counteracted and the isolation between feedpoints is further improved.

Also, in the present invention, the ground area has a notched portion crossing the intersection line between the ground area and the imaginary plane, and the third conductor is disposed crossing the notched portion.

By this structure, the flux generated near the third conductor is less influenced by the ground area, and the magnetic coupling between the first conductor and the third conductor become stronger. The coupling intensity can be adjusted by changing the depth of the notched portion, which will further adjust the frequency band of the second feedpoint. By further arranging the notched portion, the ground area will be intensely excited as the radiation conductors. Thus, the radiation efficiency of the antenna upon the input of electricity from the second feedpoint will be improved.

Further, the notched portion can be either disposed in the end portion of the ground area or within the ground area if it will not affect the flux.

In the present invention, at least one part of any of the first, second and third conductors is formed on the surface of and/or inside a base body, which is formed of dielectric material and/or magnetic material.

By this structure, it will be easy to dispose the first conductor apart from the substrate or to dispose a long conductor by turning back two front end so that the antenna device can be in low frequencies. The radiation efficiency will be improved and the antenna device will be miniaturized as well.

According to the present invention, an antenna device will be obtained in which isolation among feedpoints is further improved.

DETAILED DESCRIPTION OF EMBODIMENTS

The embodiments of the present invention will be described in detail with reference to the accompanying drawings. However, the present invention will not be limited to these embodiments. The components described below refer to those easily come up to those skilled in the art. And a component refers to the same or similar ones. Further, these components can be appropriately used in combination.

The feedpoints, in view of convenience, are disposed in the edges of a substrate or somewhere away from the substrate. Actually, power is fed to the radio circuit of the substrate and transmitted to the edges via any means that works.

Embodiment 1

Figure 1:
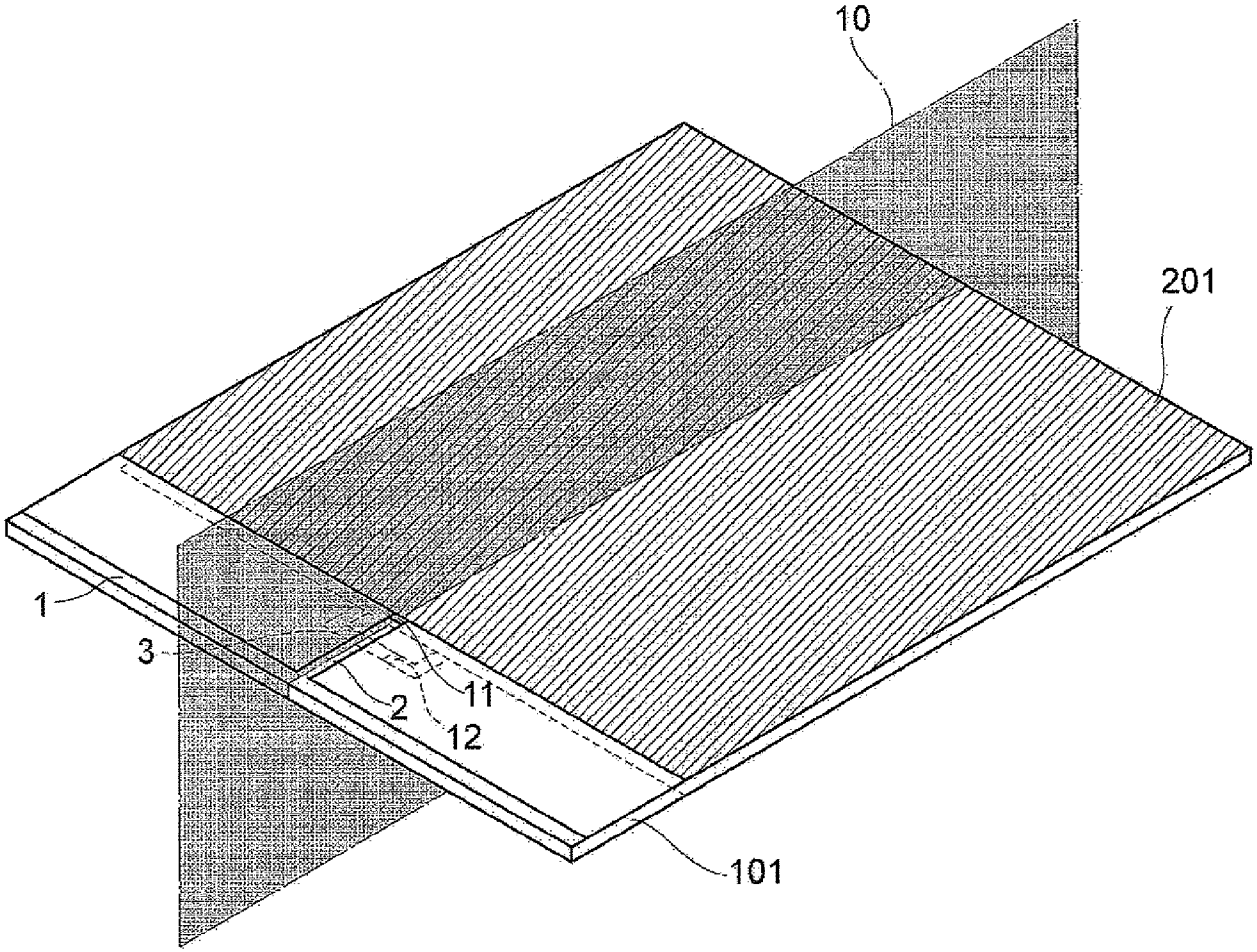
FIG. 1 is an oblique view showing the antenna device of Embodiment 1.
Figure 2:
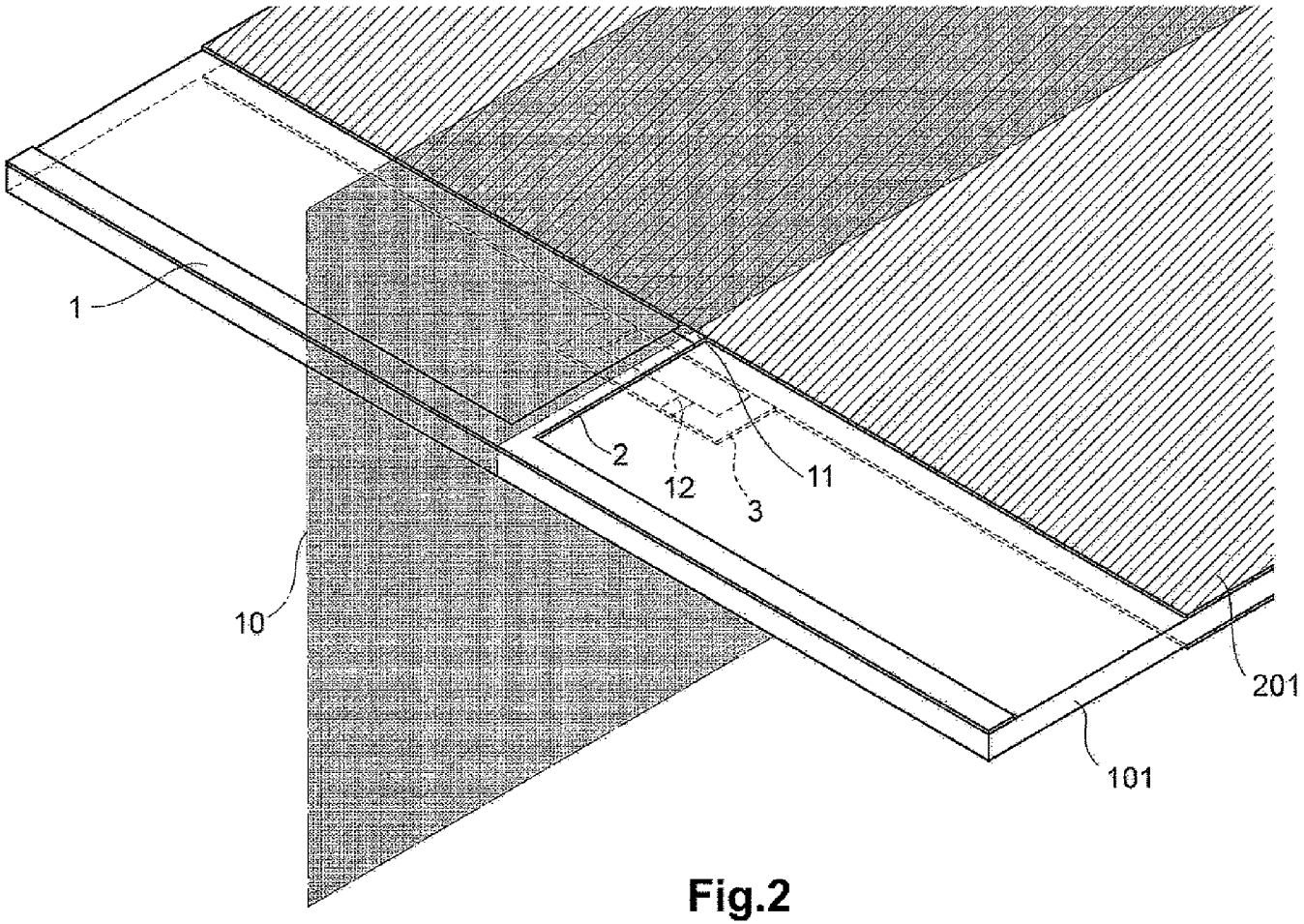
FIG. 2 is an oblique view showing the detail of the feedpoints of the antenna device of Embodiment 1.
Figure 3:
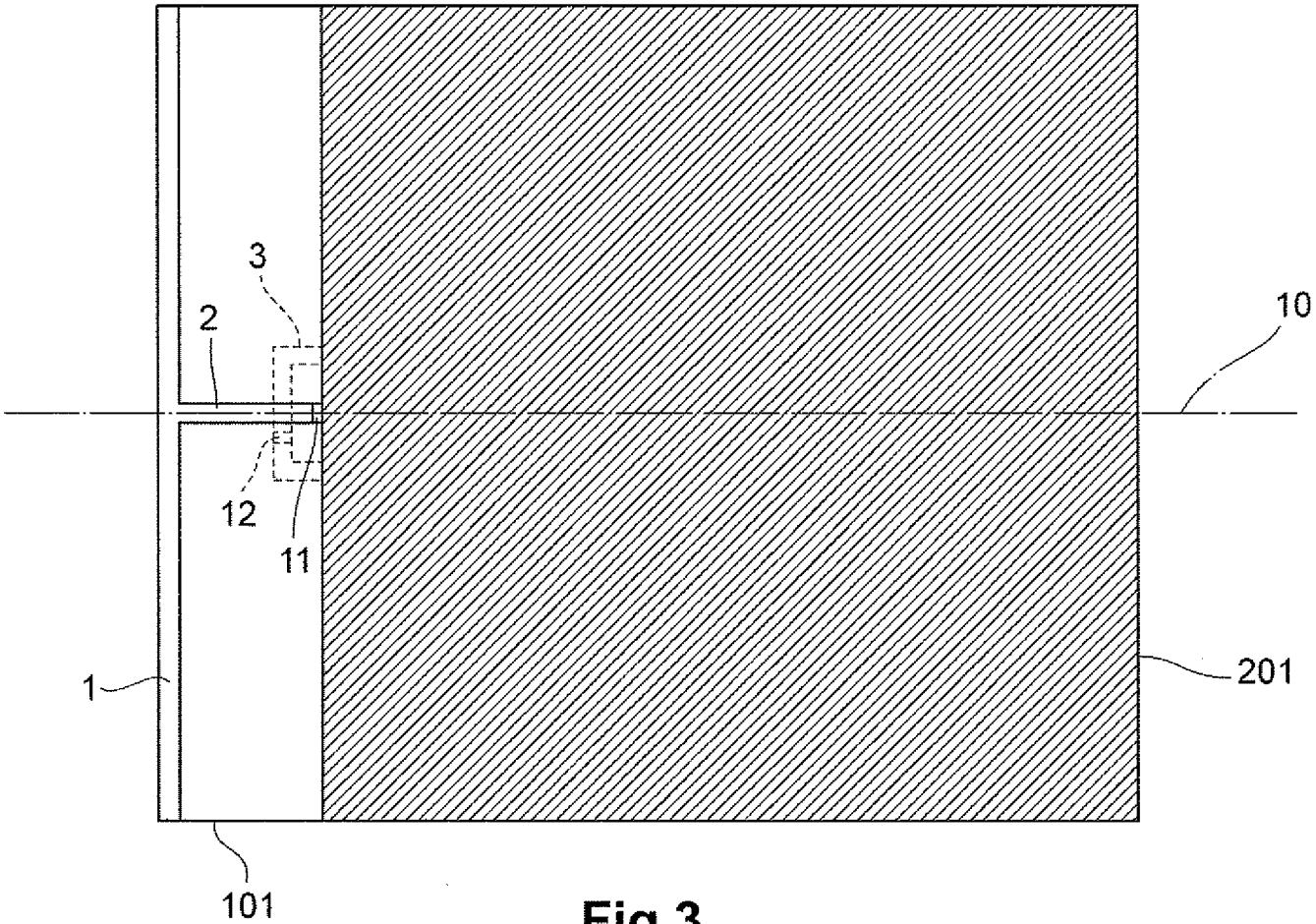
FIG. 3 is a top view showing the antenna device of Embodiment 1.

FIG. 1 is an oblique view showing the antenna device of Embodiment 1. FIG. 2 is an oblique view showing the detail of the feedpoints of the antenna of Embodiment 1. FIG. 3 is a top view showing the antenna device of Embodiment 1. Substrate 101 is 60 mm×50 mm in size. The thickness is 1 mm. The antenna device, as shown in FIGS. 1, 2 and 3, comprises a substrate having a ground area 201, and a first conductor, a second conductor and a third conductor. One end of the second conductor 2 is connected to the ground area 201 via a first feedpoint 11 and the other end is connected to the first conductor 1. A second feedpoint 12 is comprised serially in the third conductor 3 at any position. At least part of the third conductor 3 is disposed opposite to the first conductor 1, and both ends of the third conductor 3 are connected to the ground area 201.

With such a configuration, the first feedpoint 11 and the first conductor 1 are connected by the second conductor 2. In contrast, the second feedpoint 12 and the first conductor 1 are not connected by a conductor and electricity is supplied in a non-contact way by magnetic coupling in the place where the first conductor is disposed opposite to the third conductor. Therefore, there is no signal transmission path via a conductor between the first feedpoint 11 and the second feedpoint 12. Accordingly, the interference among the signals can be inhibited.

Further, the first feedpoint 11 functions as a feedpoint corresponding to a monopole antenna which uses the first conductor 1 and the second conductor 2 as radiation conductors, and the second feedpoint 12 serves as a feedpoint corresponding to a dipole antenna which uses the first conductor 1 as a radiation conductor, since the resonance are in different directions. So the interferences caused by electrical signals passing through the ground area 201 are inhibited. With this effect, the interferences between the feedpoints are inhibited and the isolation between feedpoints is improved.

As shown in FIGS. 1, 2 and 3, the first conductor 1 and the ground area 201 respectively have a shape that is plane symmetrical with respect to a selected imaginary plane 10 which is vertical to the primary plane of the substrate 101, and the connecting point of the first conductor 1 and the second conductor 2 is disposed on the imaginary plane 10.

With such a configuration, the first conductor 1 has a shape that is plane symmetrical with respect to the imaginary plane 10. The standing waves that are excited by the second feedpoint 2 and then generated in the first conductor 1 are central symmetrically distributed in the imaginary plane 10. The space near the intersection point of the first conductor 1 and the imaginary plane 10 is in a virtual grounding state that nearly no potential change is found. Thus, by arranging the connecting point of the first conductor 1 and the second conductor 2 on intersection points of the imaginary plane 10 and the first conductor 1, the components of the signal from the second feedpoint 12 passing to the first feedpoint 11 via magnetic coupling will become less. Then, the isolation between feedpoints will be improved.

Further, the second feedpoint 12 is disposed in the intersection line of the ground area 201 and the imaginary plane 10, and the second conductor 2 is on the imaginary plane 10. Thus, the standing waves excited in the second feedpoint 12 and generated in the first conductor 1 will be less influenced by the second conductor 2. Accordingly, the isolation will be improved.

As shown in FIGS. 1, 2 and 3, two end portions of the third conductor 3 are positioned so as to clamp the imaginary plane and are presented symmetrical with respect to the imaginary plane.

The electrical signal input in the first feedpoint 11 is transmitted to the first conductor 1 through the second conductor 2. Regarding the connecting point of the first conductor and the second conductor as base point, the transmitted electrical signal passes in a reverse direction, so a magnetic field is generated near the first conductor in an opposite direction regarding the connecting point between the first and second conductors as base point. As the third conductor 3 is connected to the ground area 201 with its two end portions disposed to clamp the imaginary plane 10 and the third conductor 3 is almost symmetrical with respect to the imaginary plane 10, the area where the magnetic fields are generated clamp the imaginary plane 10 and is symmetrical with respect to that plane. Thus, the magnetic fields generated in opposite directions will be equally coupled and have most magnetic fields counteracted. In this way, the components of the signal passing from the first feedpoint 11 to the second feedpoint 12 via magnetic coupling will become less. Then, the isolation will be further improved.

In the present embodiment, the first feedpoint 11, the first conductor 1 and the second conductor 2 are disposed in one primary plane of the substrate 101, and the second feedpoint 12 and the third conductor 3 is disposed in another primary plane.

As described in the present embodiment, it is preferred that the first, second and third conductors are configured in two layers of the substrate, since there is no need to prepare the member forming conductor member by other means, so the antenna device will be simplified.

In the antenna device of Embodiment 1, as the first feedpoint 11 functions as a feedpoint corresponding to a monopole antenna which uses the first conductor 1 and the second conductor 2 as radiation conductors, the standing wave is generated in a direction that is vertical to one side of the ground area 201 where feedpoints are disposed. Further, the second feedpoint 12 serves as a feedpoint corresponding to a dipole antenna which uses the first conductor 1 as a radiation conductor, so the standing waves generated there are paralleled to said side. It can be seen resonances are generated orthogonally, leading to low correlation values.

As the resonances are generated in different directions, the interference of the signals passing through the ground area 201 can be inhibited between two feedpoints. In another aspect, the second feedpoint 12 is fed when it is apart from the first conductor 11 which is deemed as a radiation conductor, the first feedpoint 11 and the second feedpoint 12 are not directly connected by conductors and the interference caused by the signals passing through conductors are inhibited. As for the reasons above, it can be used as the antenna device having the isolation improved.

The state with "low correlation values" refers to that each polarization plane is different from each other when the feedpoints are excited. The correlation coefficient is used to evaluate the correlation value. If the polarization planes are the same, the correlation coefficient is close to 1, while the coefficient will tend to be 0 if the planes are orthogonally generated.

Embodiment 2

Figure 4:
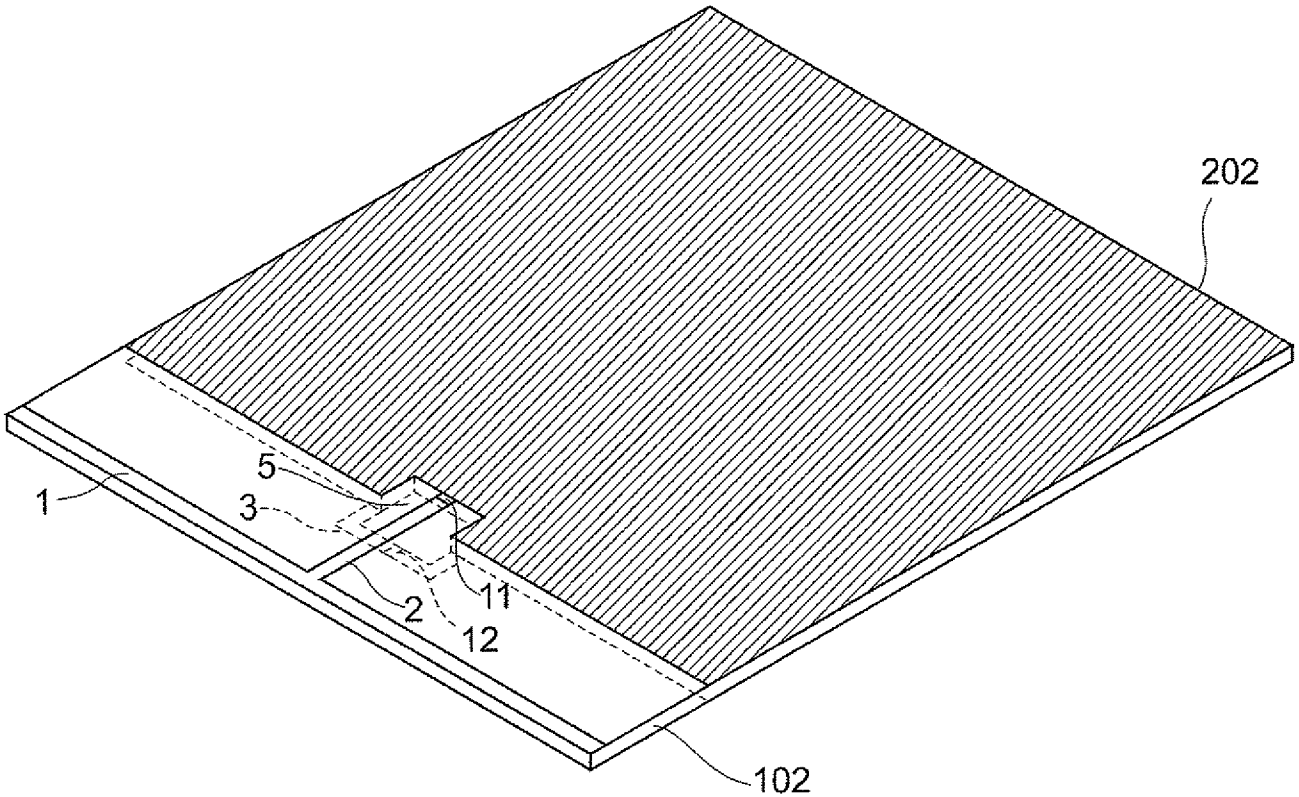
FIG. 4 is an oblique view of the antenna device of Embodiment 2.

FIG. 4 is an oblique view showing the antenna device of Embodiment 2. Compared to Embodiment 1, the ground area 202 of Embodiment 2 has a notched portion 5 crossing the intersection line of the ground area 202 and the imaginary plane 10, and the third conductor 3 is disposed crossing the notched portion 5.

By this structure, the flux generated near the third conductor 3 is less influenced by the ground area 202, and the magnetic coupling between the first conductor 1 and the third conductor 3 become stronger. The coupling intensity can be adjusted by changing the depth of the notched portion 5, which will further adjust the frequency bands of the second feedpoint 12. By arranging the notched portion 5, the ground area 202 will be excited as intense as the radiation conductors. Also, the radiation efficiency of the antenna device will be improved.

Embodiment 3

Figure 5:
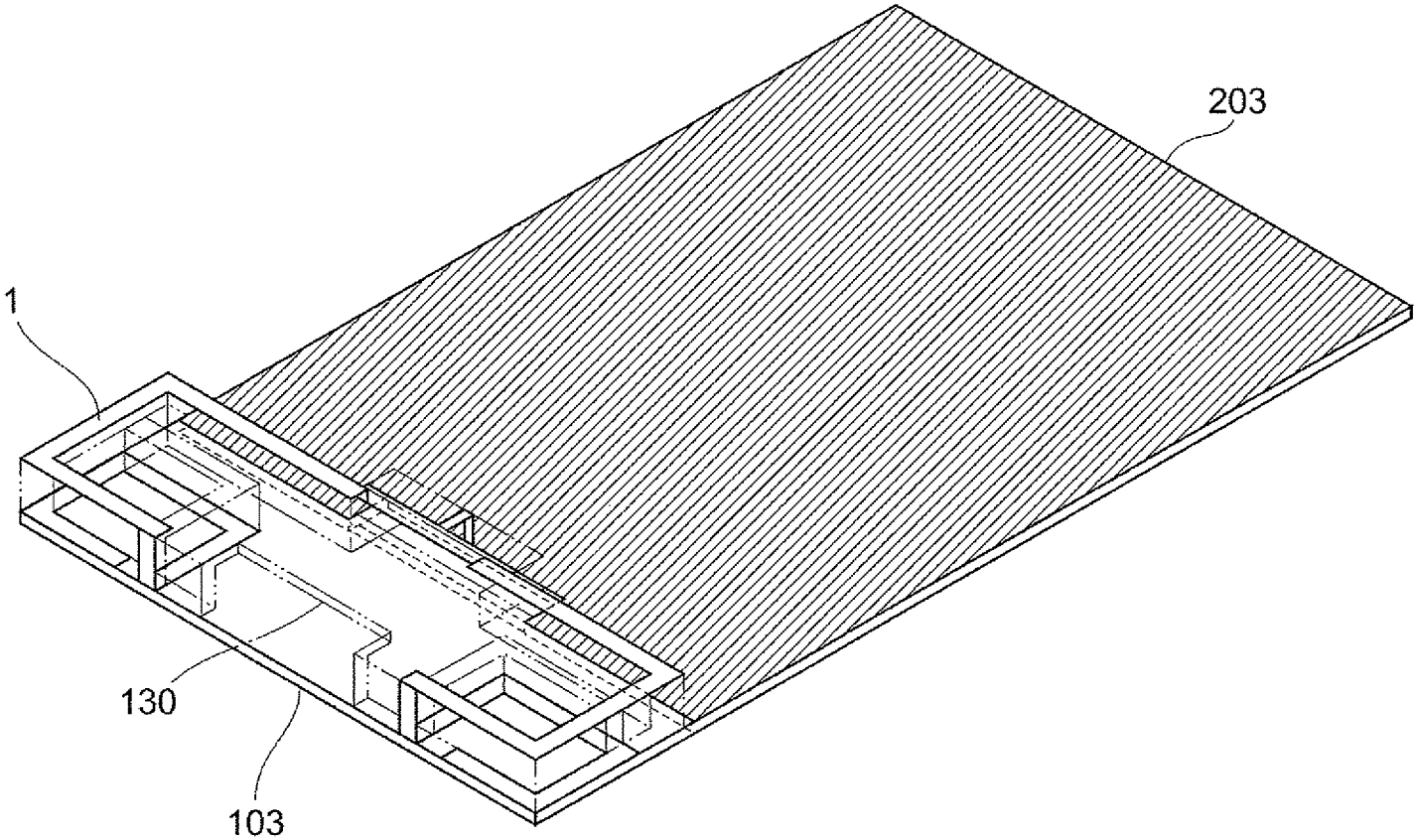
FIG. 5 is an oblique view of the antenna device of Embodiment 3.
Figure 6:
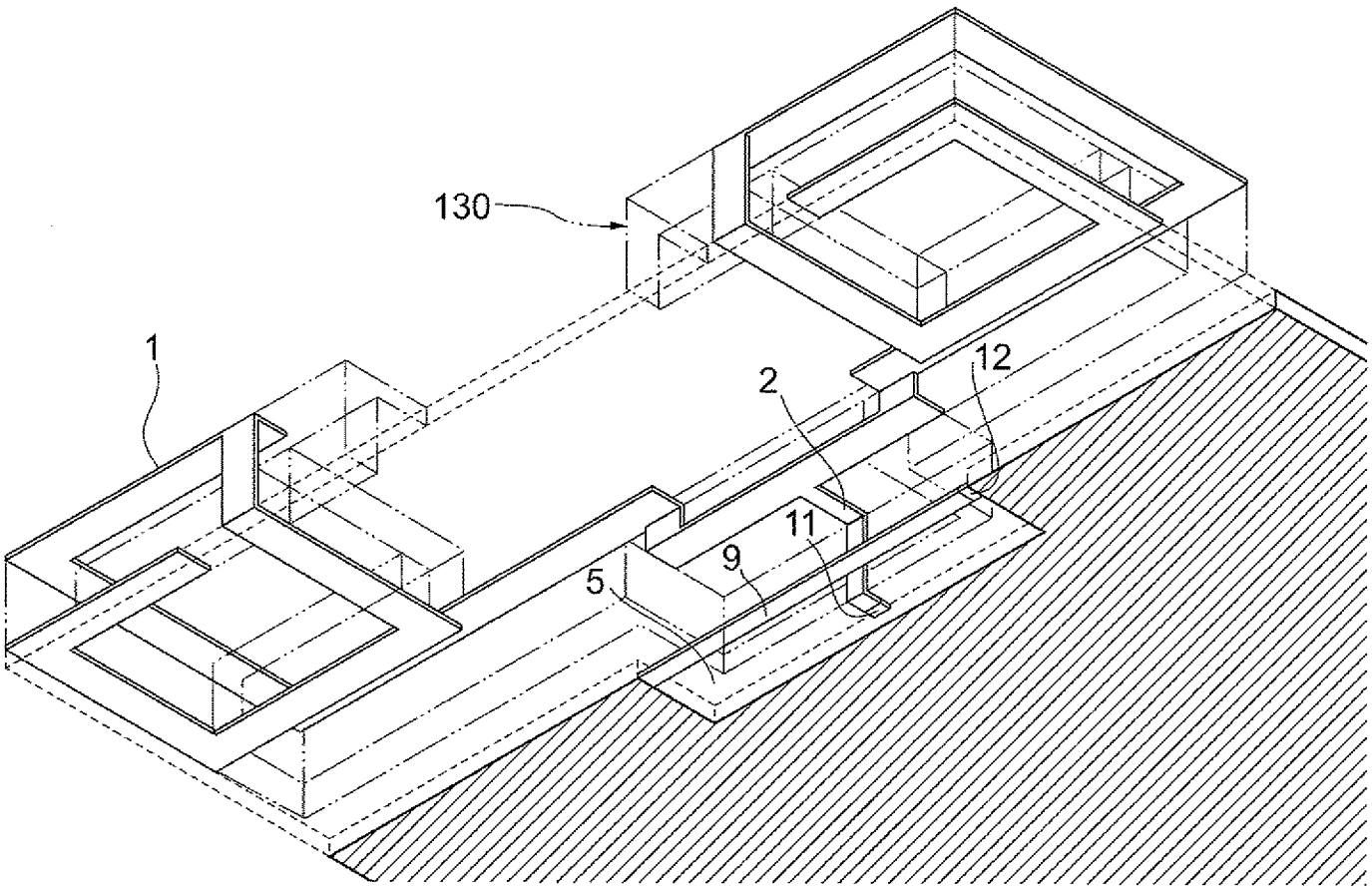
FIG. 6 is an oblique view showing the detail of the feedpoints seen from the downside of the antenna device of Embodiment 3.
Figure 7:
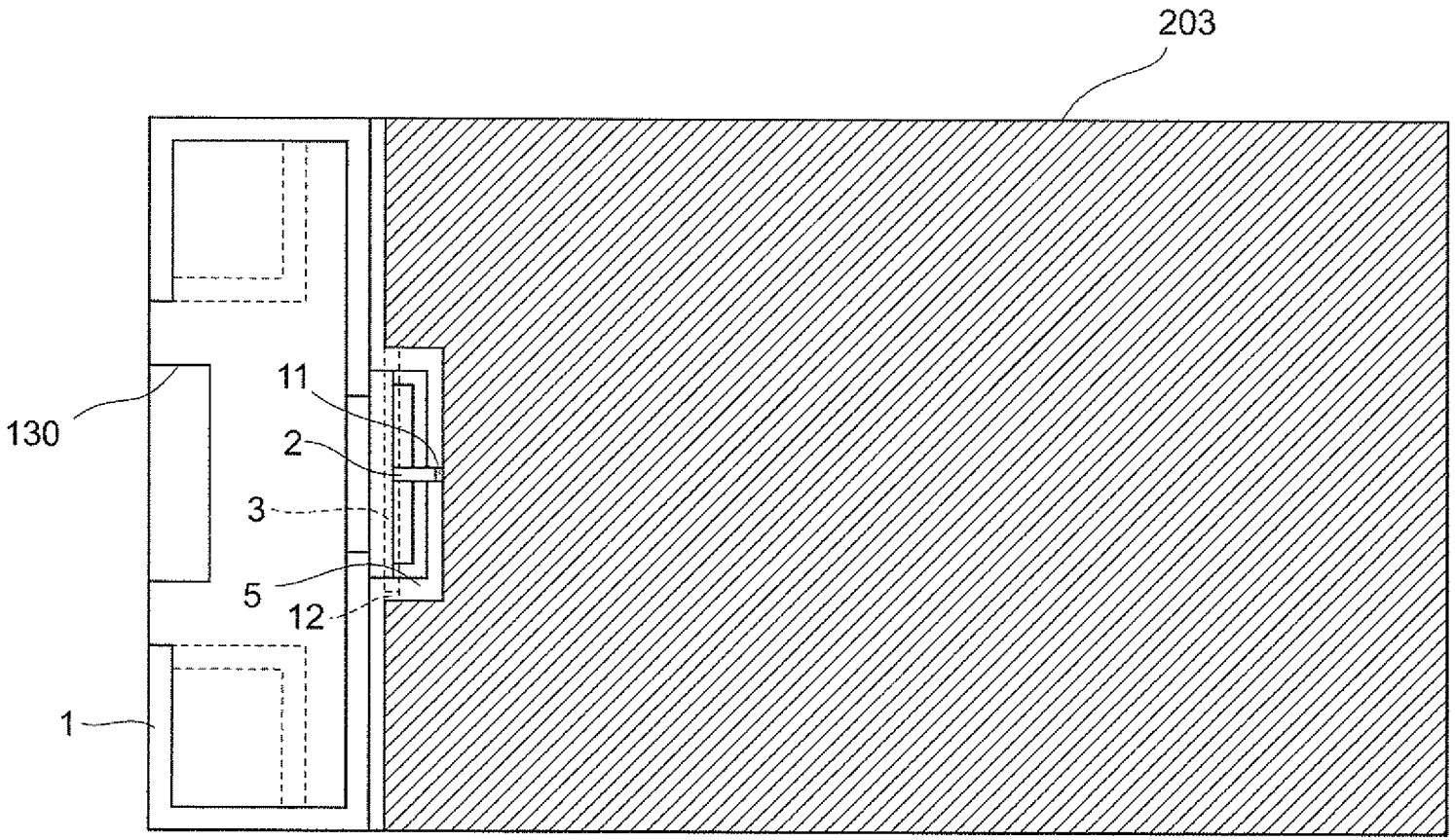
FIG. 7 is a top view of the antenna of Embodiment 3.

FIG. 5 is an oblique view of the antenna device of Embodiment 3. FIG. 6 is an oblique view showing the detail of the feedpoints of the antenna of Embodiment 3. FIG. 7 is a top view showing the antenna device of Embodiment 3. Substrate 103 is 110 mm×60 mm in size and the thickness is 1 mm, and a base body 130 disposed on the substrate 103 is 60 mm×18.5 mm×5 mm in size.

Compared to Embodiment 2 in which the first conductor 1, the second conductor 2 and the third conductor 3 are all formed in the substrate 101, in Embodiment 3, any part or all of the first, second and third conductors are formed in the surface of the base body 130 which is prepared as a dielectric by other means.

In the present embodiment, the whole first conductor 1 and part of the second conductor 2 are disposed on the surface of the base body 130. The base body 130 is almost cuboid and has a smaller cuboid adjacent to the feedpoint. This smaller cuboid can be omitted in some designs. The base body 130 is made by polycarbonates which is cheap in price and has a relatively low dielectric constant. The polycarbonates can be hollowed out to further decrease the actual dielectric constant.

The material for the base body 130 can be magnetic substances, in addition to ceramics and resins. They have the required characteristics and effective relative dielectric constant or relative permeability. Elements having different properties can be used in combination. If the dielectric constant has to be low, the base body can be hollowed out. Further, if a lamina having a conductor inside is to be prepared, a long and complex pattern can be considered such as a coil spanning several layers.

When the base body 130 is used as described above, it will be easy to separate the first conductor 1 from the ground area 203. And it will be easy to prepare the first conductor 1 in a long and complex pattern. Thus, it is possible to reduce the area in the substrate occupied by the antenna device. Then, in characteristics of antenna, such a shape of the base body can decrease the operating frequencies, expand the band width and improve the radiation efficiency.

Also, in the present embodiment, one end of the second feedpoint 12 is disposed on an end portion of the third conductor 3 and the other end is directly connected to the ground area 203. The second feedpoint 12 is thus configured that it can be treated as imbalanced input and output just as the first feedpoint 11. Radio circuits usually have imbalanced input and output, the configuration mentioned above will make the design or preparation of the radio device easier.

Embodiment 4

Figure 8:
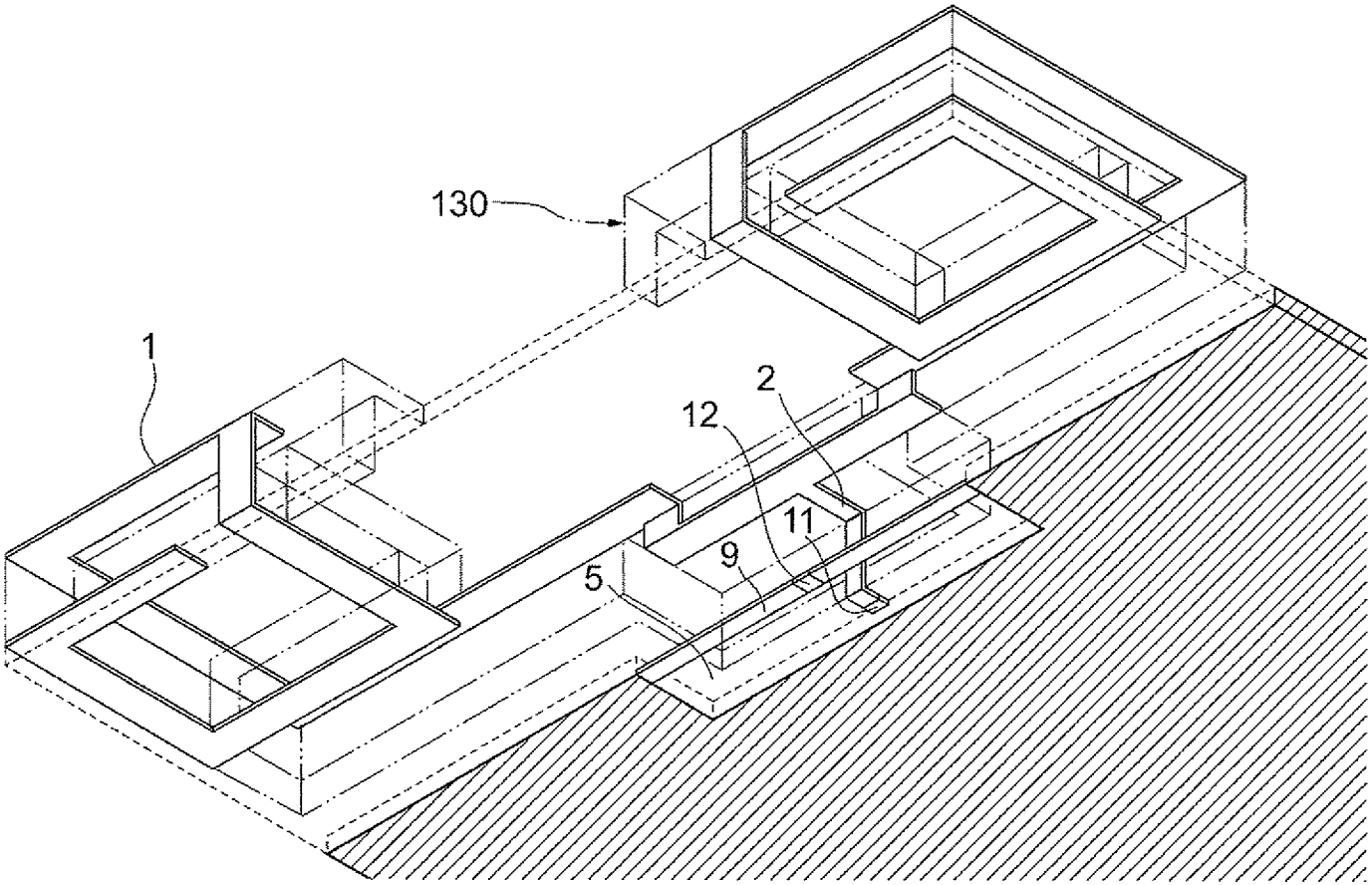
FIG. 8 is an oblique view showing the detail of the feedpoints seen from the downside of the antenna device of Embodiment 4.

FIG. 8 is an oblique view showing the detail of the feedpoints of the antenna device of Embodiment 4. Compared to Embodiment 3 in which the second feedpoint 12 is disposed between the end portion of the third conductor 3 and the ground area 203, the second feedpoint 12 of Embodiment 4 is comprised serially in the third conductor 3 and is disposed at the intersection point of the third conductor 3 and the imaginary plane 10.

With the configuration mentioned above, the whole antenna including the feedpoints is symmetrical with respect to the imaginary plane 10. As for the reasons mentioned above, the components of the signal from the first feedpoint 11 to the second feepoint 12 via magnetic coupling are eliminated and the isolation is further improved.

Figure 9:
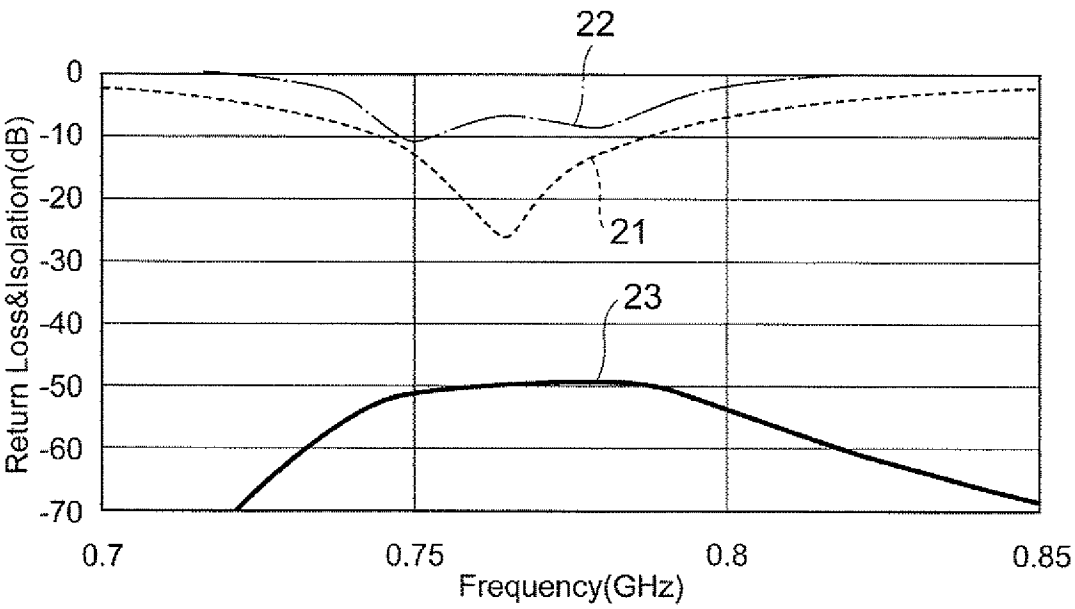
FIG. 9 shows the simulation result obtained from the antenna device of Embodiment 4.

The simulation result obtained from the antenna device of Embodiment 4 is presented in FIG. 9. The electrical characteristics shown in FIG. 9 are obtained in a state that the impedance before each feedpoint is adjusted to 50 ohm. The simulation is performed in HFSS Version-14 (Ansys, Inc.). Line 21 represents the return loss obtained from the first feedpoint 11. Line 22 represents the return loss obtained from the second feedpoint 12 and Line 23 represents the isolation between the first feedpoint 11 and the second feedpoint 12. Further, the correlation coefficient is 0.0012 calculated from the simulated radiation pattern. It can be seen the present embodiment can largely improved the isolation and obtain a sufficiently low correlation value.

The antenna device of the present invention can be applied when a plurality of antenna devices are to be equipped in a same radio communication equipment.

DESCRIPTION OF REFERENCE NUMERALS

1 a first conductor
2 a second conductor
3 a third conductor
5 a notched portion
10 an imaginary plane
11 a first feedpoint
12 a second feedpoint
21 the return loss obtained from the first feedpoint
22 the return loss obtained from the second feedpoint
23 the isolation between the first feedpoint and the second feedpoint
101, 102, 103 substrates
130 base body
201, 202, 203 ground areas

What is claimed is:

1. An antenna device, provided with:

a substrate having a ground area, and a first conductor, a second conductor and a third conductor, one end of the second conductor being connected to the ground area via a first feedpoint and the other end of the second conductor being connected to the first conductor, a second feedpoint disposed at a position along the third conductor, the second feedpoint not being directly connected to the ground area, at least part of the third conductor is disposed opposite to the first conductor, and both ends of the third conductor are directly connected to the ground area, wherein the first conductor and the ground area respectively have a shape that is plane symmetrical with respect to a selected imaginary plane vertical to the primary plane of the substrate, and the connecting point of the first conductor and the second conductor is disposed on the imaginary plane, two end portions of the third conductor are positioned so as to clamp the imaginary plane, the third conductor has a shape that is substantially plane symmetrical with respect to the imaginary plane, the second feedpoint is disposed on the imaginary plane, and the ground area has a notched portion crossing the intersection line of the ground area and the imaginary plane, and the third conductor is disposed crossing the notched portion.

2. The antenna device of claim 1, wherein, at least one part of any of the first, second and third conductors is formed on the surface of and/or inside a base body, which is formed of dielectric material and/or magnetic material.

* * * * *